United States Patent [19]

Dunham

[11] 3,974,585

[45] Aug. 17, 1976

[54] GUN SIGHT NIGHT LIGHTING ATTACHMENT

[76] Inventor: Charles W. Dunham, 6990 Matchette Road, Windsor, Ontario, Canada

[22] Filed: Oct. 24, 1974

[21] Appl. No.: 517,608

[52] U.S. Cl. ..... 42/1 S; 33/241; 42/1 A

[51] Int. Cl.[2] ..... F41G 1/34

[58] Field of Search ..... 42/1 A, 1 S; 33/241; 240/2 F

[56] References Cited

UNITED STATES PATENTS

| | | | |
|---|---|---|---|
| 731,712 | 6/1903 | Schlaegel | 42/1 A |
| 802,277 | 10/1905 | Fric | 33/241 |
| 2,158,915 | 5/1939 | Searcy | 42/1 A |
| 2,385,649 | 9/1945 | Prideaux | 42/1 S |
| 2,529,057 | 11/1950 | Teffault | 33/241 |
| 2,546,242 | 3/1951 | Stinson | 42/1 A |
| 3,098,303 | 7/1963 | Plisk | 33/241 |
| 3,439,970 | 4/1969 | Rickert | 42/1 S |

*Primary Examiner*—Charles T. Jordan
*Attorney, Agent, or Firm*—Lane, Aitken, Dunner & Ziems

[57] ABSTRACT

This invention relates to gun sight lighting device and more particularly to an attachment that can be affixed to a gun sight to enable the gun and the sight to be used in situations where very little incidental light is present. The attachment consists of a source of light that is attached to a gun sight of the type that operates on the principle of superimposing a sighting image on a target. The light source is directed specifically at illuminating the object that is used to develop the sighting image so that the gun sight can be used in conditions where the level of incidental light present is insufficient to enable the sighting image to be readily seen by the user of the sight, but the level of incidental light is sufficient to permit the target to be seen by the user of the sight.

10 Claims, 5 Drawing Figures

GUN SIGHT NIGHT LIGHTING ATTACHMENT

This invention relates to gun sight lighting device and more particularly to an attachment that can be affixed to a gun sight to enable the gun and the sight to be used in situations where very little incidental light is present.

BACKGROUND OF THE INVENTION

Many modern gun sights employ a prism and/or mirror reflecting system whereby the user of the gun looks through the sight and sees an optical sighting image superimposed upon the target. A gun sight of this nature is fully described and claimed in U.S. Pat. No. 3,439,970. A gun sight using an optical image is available on the market and is known as the Weaver "Qwik-Point" (Trademark) sight, Model R–1, U.S.A.

Another type of gun sight is designed to permit the user of the gun to use both eyes in lining the gun up with the target. One eye is used to look through the sight and the other is used to look alongside the sight at the target. The brain of the user then collates the two images seen by the two eyes to assist in lining the gun up with the target.

Essentially, the Weaver "Qwik-Point" (Trademark) sight presents to the viewer a spot or dot sighting image which is developed by means of a thin red, or similarly coloured, glass or transparent plastic rod, such as "LUCITE" (Trademark), which is located in a horizontal position parallel to the barrel of the rifle within a transparent glass or plastic housing at the front of the sight. This thin glass or plastic rod, located inside the transparent plastic housing, collects daylight and transmits it through the end of the rod nearest the viewer. The end of the rod is then seen by the viewer by means of a series of prisms and mirrors which superimpose the image of the rear tip of the rod in the centre of a tube that is located below the chamber houses the thin glass or plastic rod and the transparent housing. The effect of this rod tip imaging system is that when the viewer sights through the lower tube, which is located immediately above the rifle, the viewer sees a red or similarly coloured dot superimposed upon the target. The dot represents the path along which the bullet will travel when the rifle is fired. To use the sight in combination with the rifle, the user of the rifle lines the rifle up with the intended target by sighting through the tube and superimposing the red or similarly coloured dot on the target area which he intends to hit with the bullet.

The Weaver "Qwik-Point" (Trademark) sight is very useful during the day when there is substantial incidental light about because it enables the user of the rifle to position the image spot on the target quickly and thereby line the rifle up with the target quickly. However, as the amount of incidental light decreases, it becomes increasingly difficult for the viewer to see the red or similarly coloured dot superimposed on the target. Consequently, the Weaver "Qwik-Point" (Trademark) sight is less than ideal in relatively dark conditions.

To enable the Weaver "Qwik-Point" (Trademark) sight, and other gun sights which operate on a similar image superimposing principle, to be used in conditions where there is very little incidental light present, I have invented an attachment which fastens readily to the sight and enables the sight to be used in almost all conditions of light. The only requirement is that there must be sufficient incidental light present to permit the target to be seen by the user of the sight. Since there are very few situations where the target is not illuminated by incidental light to the point that it can be seen dimly, my attachment greatly increases the usefulness of the Weaver "Qwik-Point" (Trademark) sight, and other similar sighting devices.

SUMMARY OF THE INVENTION

My invention consists of a gun sight lighting attachment comprising a source of light which is attached to a gun sight of the type that operates on the principle of superimposing a sighting image on a target and which light source is directed specifically at illuminating the object that is used to develop the sighting image so that the gun sight can be used in conditions where the level of incidental light present is insufficient to enable the sighting image to be readily seen by the user of the sight, but the level of incidental light is sufficient to permit the target to be seen by the user of the sight.

The attachment may be constructed mainly of plastic, aluminum or an alluminum alloy so that it will be durable but light in weight. The light source may be a battery and a light bulb combination which is readily portable. To avoid too much occasional light, which tends to present distractions, the light from the light source in my attachment is directed specifically at the object that is used to develop the sighting image. The light source can be turned on or off. Means also included to enable the user of the sight to determine whether the light source is on or off.

A pin-hole can be used as the means for directing the light from the light source specifically at the object that is used to develop the sighting image. The portion of the attachment that fits with the gun sight is machined to provide a snug but readily detachable fit between the attachment and the gun sight.

DRAWINGS

DETAILED DESCRIPTION OF THE INVENTION

Figure 1:
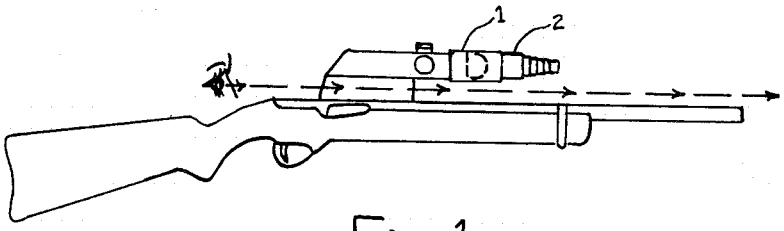
FIG. 1 represents a three dimensional view of the attachment in place on a gun sight mounted on a rifle.
Figure 2:
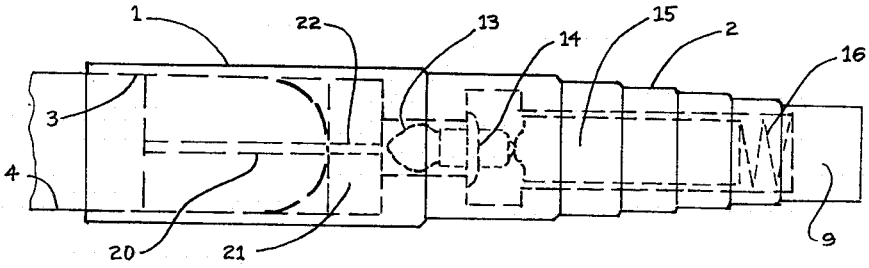
FIG. 2 represents a side view of the attachment in place on a gun sight.

The gun sight lighting attachment consists of two main parts, namely, a gun sight fitting 1 and a battery holder 2. The gun sight fitting 1 is mainly cylindrical in construction. As seen in FIG. 2, the interior surface 3 of the fitting 1 is machined to close tolerances so that it fits snuggly but detachably about the front end of the Weaver "Qwik-Point" sight 4. It will be understood, however, that rather than a snug fit, some other design such as a rubber washer or clamp-like device can be used to provide a secure fit between the attachment and the front end of the sight.

Figure 4:
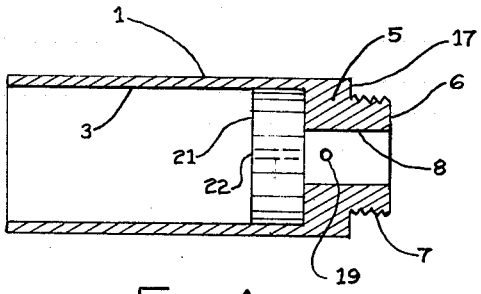
FIG. 4 represents a partially sectioned side view of the gun sight fitting component of the attachment.

The end 5 of the gun sight fitting 1 opposite the end that fits over the Weaver "Qwik-Point" (Trademark) sight (See FIG. 4) is machined so that it has a somewhat cup-like appearance. Extending from this closed end 5 is a cylindrical projection 6 upon which are machined male threads 7. The cylindrical projection 6 is of a narrower diameter than the diameter of the gun sight fitting 1 and is positioned so that its centre line aligns with the centre line of the gun sight fitting 1. Machined in the cylindrical projection 6 along the centre line is a cylindrical opening 8. This cylindrical opening 8 is of a smaller diameter than the cylindrical projection 6.

The exterior of the battery holder 2 has a generally tapering or telescoping shape. The battery holder is open at one end. In the embodiment shown in FIGS. 2 and 4, the exterior of the battery holder 2 is constructed in the form of a series of adjoining cylinders all having a common axis and increasingly smaller diameters until the closed end 9 of the battery holder 2 is reached.

The interior of the battery holder 2 is hollow and machined to different diameters in order to form a battery receptacle 10 and a larger diameter light bulb receptacle 11. The battery receptacle 10 and the light bulb receptacle 11 are substantially cylindrical in shape and have a common axis with the axis of the battery holder. The light bulb receptacle 11 has female threads 12 machined about its circumference to the open end of the battery holder 2. The female threads 12 are machined to coordinate with and be of approximately the same diameter as the male threads 7 of the gun sight fitting 1. By means of the similar dimensions of the female threads 12 and the male threads 7, the gun sight fitting 1 can be screwed into the battery holder 2. Of course, other methods rather than threads, for example, interlocking slots, can be used to provide a secure readily disconnectable joint between the gun sight fitting 1 and the battery holder 2.

When the gun sight fitting 1 is screwed into the battery holder 2, the cylindrical opening 8, the battery receptacle 10, and light bulb receptacle 11, provide a chamber which is large enough to hold a light bulb 13, a light bulb holder 14, and a battery 15 (See FIG. 2). To keep the dimensions of the gun sight fitting 1 and the adjoining battery holder 2 relatively small, it is preferable that the light bulb 13 and the battery 15 be of pen-light size. However, it will be recognized that other light source generating devices can be used.

The light bulb 13 is held in place by the light bulb holder 14. This holder 14 may be of many suitable constructions such as a coil spring that surrounds the base of the light bulb 13, or a small cylindrical holder stamped out of metal sheet or constructed of plastic. The function of the light bulb holder 14, or variant thereof, is to keep the light bulb 13 centred more or less on a line with the axis of the battery holder 2.

A battery spring 16 is positioned at the bottom of the battery receptacle 10 between the closed end 9 of the battery holder 2 and the battery 15. The function of this battery spring 16 is to apply pressure to the base of the battery 15 so that the battery 15 remains in close electrical contact with the base of the light bulb 13. Of course, other suitable obvious devices may be used in place of the battery spring 16, so long as they operate to keep the battery 15 in electrical contact with the base of the light bulb 13.

The light bulb 13 can be turned on or off by rotating the battery holder 2 in relation to the gun sight fitting 1 about the respective male threads 7 and female threads 12. By rotation in this manner, the distance between contact point 17 of the gun sight fitting 1 and contact point 18 of the battery holder 2 can be varied. By shortening the distance between the contact points 17 and 18, and indeed bringing them together, the battery 15 is brought into contact with the base of the light bulb 13, which is held in place by the light bulb holder 14 against the end of the cylindrical projection 6. An electrical current then passes from the battery 15 to the light bulb 13 thereby lighting the light bulb 13.

When it is desired to turn off the light bulb 13, the battery holder 2 is rotated several turns counter-clockwise in relation to the gun sight fitting 1. This rotation lengthens the distance between contact points 17 and 18 until electrical contact between the light bulb 13 and the battery 15 is broken. In that position, no electrical current passes from the battery 15 into the light bulb 13 and the light bulb 13 is not lit.

While the foregoing method of turning on and off the light bulb 13 is shown in the drawings, it will be readily recognized by anyone considering the construction of the attachment that an electrical switch, or other suitable on-off mechanism, can be installed on or in the battery holder 2 to turn the light bulb 13 on or off.

In order to tell when the light bulb is on or off, it is preferable to have a small observation hole 18 drilled in the side of the gun sight fitting 1. The size of this observation hole 19 should be sufficiently large so that it can be readily seen whether the light bulb 11 is on or off. But at the same time, the observation hole 19 should not be so large that a sizeable amount of light from the light bulb 11 will escape through the observation hole 19. Too much light will annoy or distract other members of any group in which the person carrying the gun might be a member, or, when conditions are relatively dark, betray the position of the person carrying the gun. concealing the position of the person carrying the gun might be important in hunting, war or police work situations. I have found that an observation hole of approximately 1/16 inch diameter is suitable.

Figure 3:
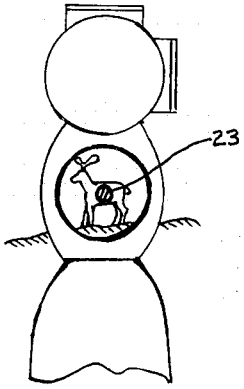
FIG. 3 illustrates the sighting image in the gun sight superimposed on a target as seen by the user of the sight.
Figure 5:
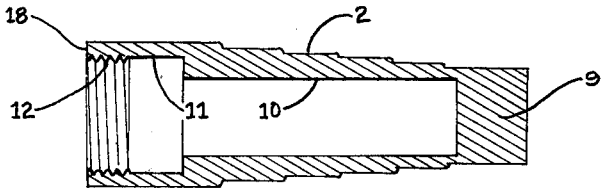
FIG. 5 represents a sectioned side view of the battery holding component of the attachment.

If the light bulb 13 were permitted to shine unimpeded upon the glass or transparent plastic rod 20 of the Weaver "Qwik-Point" (Trademark) sight 4, a distracting halo surrounding the image of the rod would be presented to the viewer. It is therefore important that the light is permitted to shine directly on only the end of the rod 20. In this way, a distinct point of light from the end of the rod 20 is presented to the viewer. To meet this requirement and eliminate the halo, I have found that an opaque disc 21 with a pin hole 22 drilled through the centre of it can be installed in the interior of the gun sight fitting 1 adjacent the closed end 5. The diameter of the disc 21 coincides with the diameter of the interior surface 3 of the sight fitting 1 so that the disc 21 fits snuggly inside the interior surface 3 adjacent the closed end 5. A linear pin hole 22 is machined along the circumferential axis of the disc 21 so that it meets and aligns with the end of the rod 20. I have found that a hole of 1/32 inch diameter permits the proper amount of light from the light bulb 13 to reach the end of the rod 20 so that the image 23 (See FIG. 3) presented to the viewer is of maximum intensity, yet is not surrounded by an annoying halo from the light bulb 13.

It should be kept in mind that it is not necessary to have the disc 21 and linear pin hole arrangement as a separate element in the gun sight fitting 1. The construction of the gun sight fitting 1 can be designed so that a predetermined width of metal will lie between the light bulb 13 and the rod 20, and that a pin hole, or some other light transmitting aperture, can be machined in this width of metal. Accordingly, the disc 21 and pin hole 22 should be regarded only as a preferred embodiment. The The advantage of a separate disc 21 is that it can be removed and replaced with another disc that is different width or has a different size of pin hole 22.

It will be appreciated by any person skilled in the art of designing gun sights that the foregoing description of the gun sight attachment is only one embodiment of the invention and that various design modifications can be made to the respective parts of the attachment and to the functions of those parts and also the attachment without departing from the overall concept of the invention. It is to be understood that any such modifications in design are to be considered to fall within the scope of my invention which is defined by the following claims.

What I claim is:

1. A gun sight lighting attachment for use with a gun sight of the type that operates on the principle of superimposing an optical sighting image on a target as seen by the sighter comprising an electric battery powered light emitting means, a battery electrically connected to the battery powered light emitting means, a light impermeable casing for housing the light emitting means and the battery, and adapted to be attached to the gun sight, and a means for causing the light emitting from the light emitting means to be directed only on the means that generates the optical sighting image without permitting any extraneous light to reach the eye of the sighter.

2. An attachment according to claim 1 wherein the light emitting means is a light bulb.

3. An attachment according to claim 1 wherein the light emitting means can be turned on or off.

4. An attachment according to claim 1 wherein the light emitting means can be turned on and off and means are included to enable the sighter to determine whether the light source is on or off.

5. An attachment according to claim 1 wherein the light emitting means is a pen light bulb and the battery is a pen light battery.

6. An attachment according to claim 2 wherein a pin hole device is positioned between the light emitting means and the means for causing the light emitted from the light emitting means to be directed only on the means that generates the optical sighting image.

7. An attachment according to claim 2 wherein the light bulb can be turned on or off by connecting or disconnecting the path of electrical current between the battery and the light bulb.

8. An attachment according to claim 2 wherein the light bulb can be turned on or off and a small pin hole type opening is present in the casing to enable the sighter to observe whether the light bulb is on or off.

9. An attachment according to claim 6 wherein the casing is constructed in two parts fitted together by a female-male thread combination, one part of the casing housing the battery, the light bulb, and a spring which forces the battery against the light bulb, the other part of the casing housing the pin hole device, the end of the casing part housing the pin hole device opposite the threaded end being machined so that it fits snuggly over the end of the gun sight without permitting any light to escape between the part and the gun sight.

10. An attachment according to claim 2 wherein the light bulb is turned on or off by tightening or loosening the threaded connection between the two parts of the casing thereby closing or breaking the electrical connection between the light bulb and the battery.

* * * * *